US009540897B2

(12) United States Patent
Drenth et al.

(10) Patent No.: US 9,540,897 B2
(45) Date of Patent: Jan. 10, 2017

(54) OVERSHOT ASSEMBLY AND SYSTEMS AND METHODS OF USING SAME

(71) Applicant: Longyear TM,Inc., South Jordan, UT (US)

(72) Inventors: Christopher L. Drenth, Burlington (CA); Anthony LaChance, Mississauga (CA); George Iondov, Mississauga (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 494 days.

(21) Appl. No.: 14/135,965

(22) Filed: Dec. 20, 2013

(65) Prior Publication Data

US 2014/0174832 A1 Jun. 26, 2014

Related U.S. Application Data

(60) Provisional application No. 61/745,039, filed on Dec. 21, 2012.

(51) Int. Cl.
*E21B 31/18* (2006.01)

(52) U.S. Cl.
CPC ..... *E21B 31/18* (2013.01)

(58) Field of Classification Search
CPC ..... E21B 31/18
See application file for complete search history.

(56) References Cited

U.S. PATENT DOCUMENTS

| | | | | |
|---|---|---|---|---|
| 2,179,594 | A * | 11/1939 | Johnson | E21B 31/20 294/86.22 |
| 3,173,719 | A * | 3/1965 | Ringler | E21B 31/14 294/86.13 |
| 3,186,745 | A * | 6/1965 | Lyles | E21B 31/18 285/277 |
| 4,281,725 | A | 8/1981 | Runk | |
| 4,591,197 | A * | 5/1986 | Akkerman | E21B 23/00 294/86.17 |
| 6,089,335 | A | 7/2000 | Able | |
| 2002/0038727 | A1 | 4/2002 | Moore et al. | |
| 2007/0259744 | A1* | 11/2007 | Lehtovaara | F16H 7/08 474/111 |
| 2009/0283327 | A1 | 11/2009 | Drenth et al. | |
| 2011/0079435 | A1 | 4/2011 | Drenth et al. | |

OTHER PUBLICATIONS

International Search Report and the Written Opinion of the International Search Authority for Application No. PCT/US/2013/076855 (mailed Apr. 15, 2014).

* cited by examiner

*Primary Examiner* — Giovanna C Wright
(74) *Attorney, Agent, or Firm* — Ballard Spahr LLP

(57) ABSTRACT

An overshot assembly for operative coupling to a wireline and a head assembly within a drilling system. The overshot assembly has at least one latch member that securely engages the inner surface of the head assembly without the use of a spearhead.

17 Claims, 16 Drawing Sheets

OVERSHOT ASSEMBLY AND SYSTEMS AND METHODS OF USING SAME

CROSS-REFERENCE TO RELATED APPLICATIONS

This application claims the benefit of the filing date of U.S. Provisional Patent Application No. 61/745,039, filed Dec. 21, 2012, which is incorporated herein by reference in its entirety.

FIELD

This application relates generally to overshot assemblies for use in drilling operations. In use, the overshot assemblies are typically positioned between and operatively coupled to a wireline and a head assembly of a drilling system.

BACKGROUND

During conventional drilling, after an inner tube of a head assembly is full of a sample, an overshot assembly is lowered (or pumped) toward the bottom of a drill hole to retrieve the head assembly. Conventional overshot assemblies include heavy-duty lifting dogs that are configured to securely grab a spearhead that is coupled to the proximal end of the head assembly. After engagement between the lifting dogs and the spearhead, the overshot is retrieved from the drill hole, and the sample is extracted from the inner tube.

Spearheads and locking dogs are typically formed by a casting process. Due to the nature of the casting process, the material of the spearhead and locking dogs is typically of reduced quality, more easily distorted, and less wear-resistant when compared to machined materials. Additionally, existing spearheads and locking dogs only function together within a narrow range of relative orientations. Due to these limitations, it can be challenging to achieve proper engagement between existing spearheads and locking dogs when conditions within the drill hole are not ideal.

Accordingly, there is a need in the pertinent art for an overshot assembly that is more robust and reliable than existing overshot assemblies. There is a further need in the pertinent art for an overshot assembly that retains its functionality over a wide range of angular orientations.

SUMMARY

Described herein is a drilling system for use in a drilling formation. The drilling system can have a head assembly and an overshot. The head assembly can have a longitudinal axis, an outer surface, an inner surface, and a proximal end. The inner surface of the head assembly can define a central bore of the head assembly, and the proximal end of the head assembly can define an opening in operative communication with the central bore. The overshot can have a distal portion configured for receipt within the central bore of the head assembly. The distal portion of the overshot can have at least one latch member configured for movement about and between a latched position and a retracted position. The inner surface of the head assembly can be configured for secure engagement with the latch members of the overshot when the latch members are positioned in the latched position. Upon secure engagement between the latch members of the overshot and the inner surface of the head assembly, the head assembly can be operatively coupled to the overshot such that movement of the overshot results in a corresponding movement of the head assembly.

The overshot assembly can have an elongate body, a driving member, and at least one latch member. The elongate body can have a wall and an outer surface, with the wall of the elongate body defining a central bore of the elongate body and at least one distal radial opening extending from the outer surface to the central bore of the elongate body. The driving member can be positioned at least partially within the central bore of the elongate body. The driving member can have a longitudinal axis and at least one wedge portion. A first wedge portion of the driving member can define at least one driving surface, with each driving surface of the first wedge portion being tapered relative to the longitudinal axis of the driving member. The latch members of the overshot assembly can be configured for receipt within the distal radial openings of the elongate body. Each latch member of the overshot assembly can be positioned in engagement with a corresponding driving surface of the first wedge portion of the driving member. Upon movement of the driving member in a first direction substantially parallel to the longitudinal axis of the driving member, the driving surfaces of the first wedge portion of the driving member can be configured to wedge the latch members between the inner surface of the head assembly and the driving surfaces such that the overshot assembly is operatively coupled to the head assembly. Upon movement of the driving member in a second direction opposed to the first direction and substantially parallel to the longitudinal axis of the driving member, the latch members of the overshot assembly can be retracted relative to the inner surface of the head assembly.

Optionally, the wall of the elongate body can define at least one proximal radial opening extending from the outer surface of the elongate body to the central bore of the elongate body. Additionally, the driving member can have a second wedge portion that defines at least one driving surface, with each driving surface of the second wedge portion being tapered relative to the longitudinal axis of the driving member. The second wedge portion can be spaced from the first wedge portion relative to the longitudinal axis of the drive member. The overshot assembly can also have at least one locking member configured for receipt within the at least one proximal radial opening of the elongate body. Each locking member of the overshot assembly can be positioned in engagement with a corresponding driving surface of the second wedge portion of the driving member. The overshot assembly can further include a locking sleeve having an inner surface configured for engagement with the outer surface of at least a portion of the elongate body. The locking sleeve can be configured for rotational movement relative to the outer surface of the elongate body about and between a locked position and an unlocked position. In the locked position, the driving surfaces of the second wedge portion of the driving member can be configured to wedge the locking members between the inner surface of the locking sleeve and the driving surfaces such that the elongate body is prevented from rotating relative to the locking sleeve. In the unlocked position, the elongate body is configured for rotation relative to the locking sleeve.

The elongate body of the overshot assembly can have a proximal portion configured for coupling to a wireline and a distal portion configured for coupling to the head assembly. The overshot can include a pivot joint element positioned between and coupled to the proximal portion and the distal portion of the elongate body of the overshot. The distal portion of the elongate body can be configured for pivotal movement in at least two planes relative to the proximal portion of the elongate body.

BRIEF DESCRIPTION OF THE DRAWINGS

These and other features of the preferred embodiments of the invention will become more apparent in the detailed description in which reference is made to the appended drawings wherein:

FIG. 6A depicts the overshot assembly before the latching members of the overshot assembly are positioned within the head assembly. FIG. 6B depicts the overshot assembly after the latching members of the overshot assembly have been advanced within the head assembly. FIG. 6C depicts the overshot assembly after the latching members are positioned in the latched position and in engagement with an inner surface of the head assembly.

FIG. 7A depicts the proximal and distal portions of the elongate body of the overshot assembly in an axially aligned configuration. FIG. 7B depicts the positioning of the distal portion of the elongate body at an angular orientation within a selected plane relative to the proximal portion of the elongate body. FIG. 7C depicts the substantially perpendicular positioning of the distal portion of the elongate body relative to the proximal portion of the elongate body within the selected plane.

DETAILED DESCRIPTION

Figure 1:
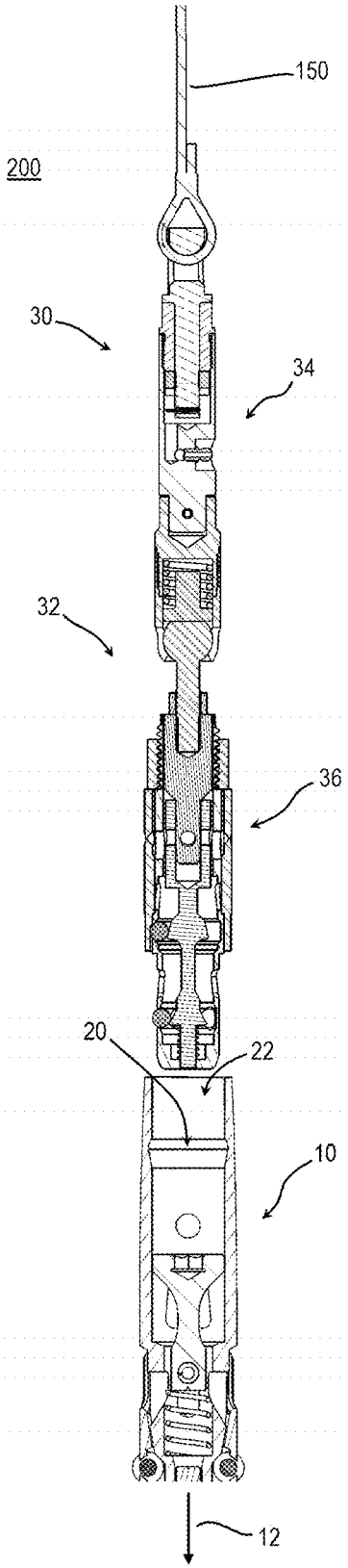
FIG. 1 is a cross-sectional front view of an exemplary drilling system having an overshot assembly as described herein.
Figure 2:
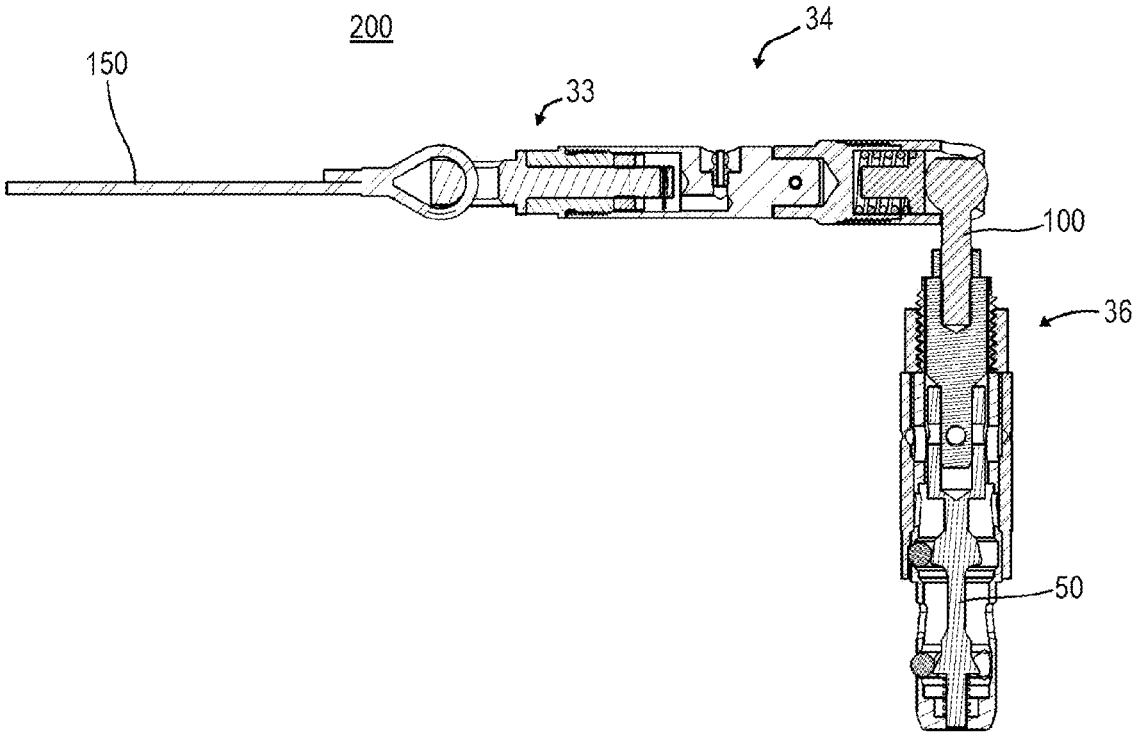
FIG. 2 is a cross-sectional front view of an exemplary overshot assembly having a pivot joint element as described herein.
Figure 3:
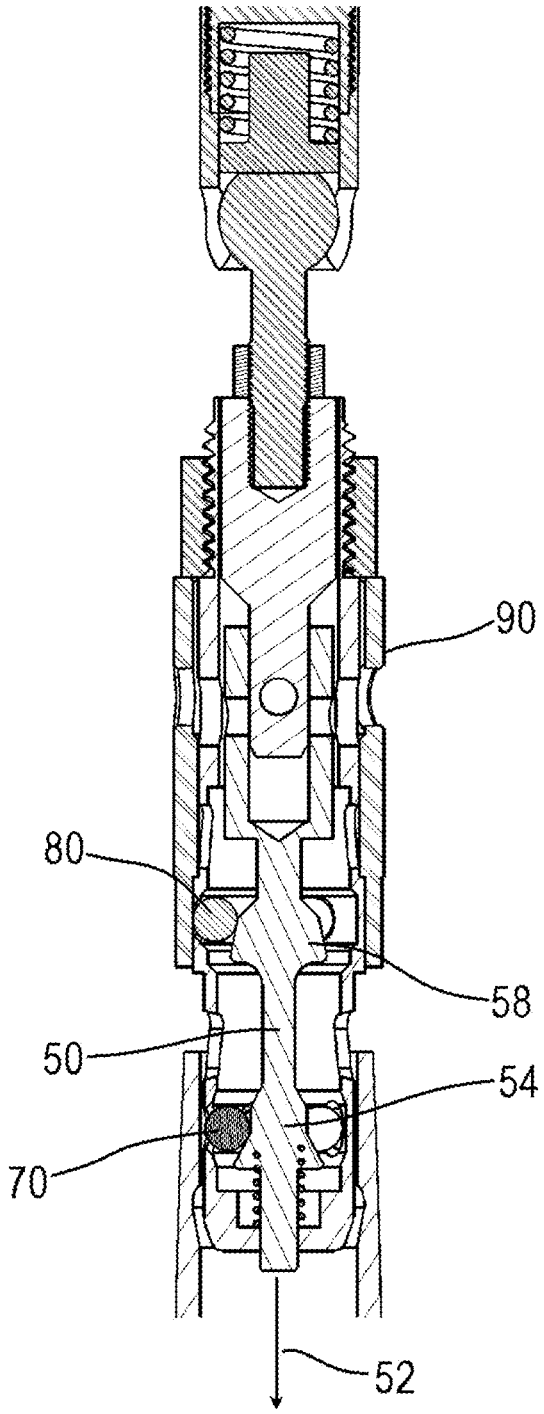
FIG. 3 is a cross-sectional front view of an exemplary overshot assembly having a pivot joint element, a locking sleeve, and latching and locking elements as described herein.
Figure 4A:
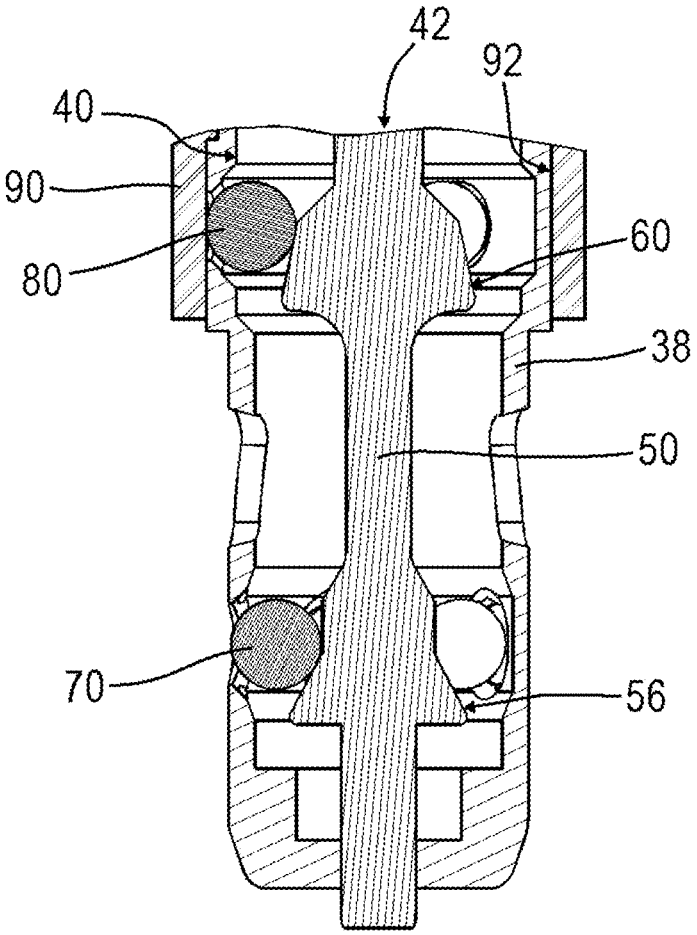
FIG. 4A is a close-up cross-sectional front view of the distal portion of the elongate body of an overshot assembly, with latching and locking elements in retracted positions as described herein.
Figure 4B:
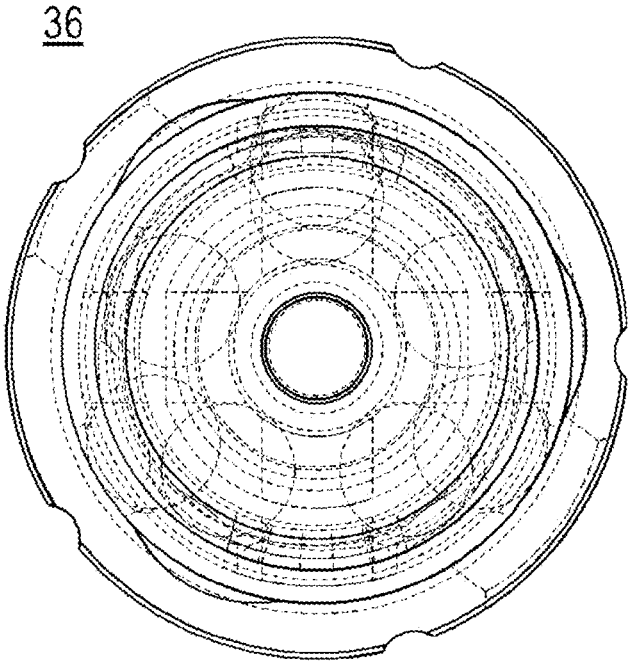
FIGS. 4B and 4C are partially transparent top views of the distal portion of the elongate body depicted in FIG. 4A. The latching and locking elements are hidden (not shown) in FIG. 4C.
Figure 4C:
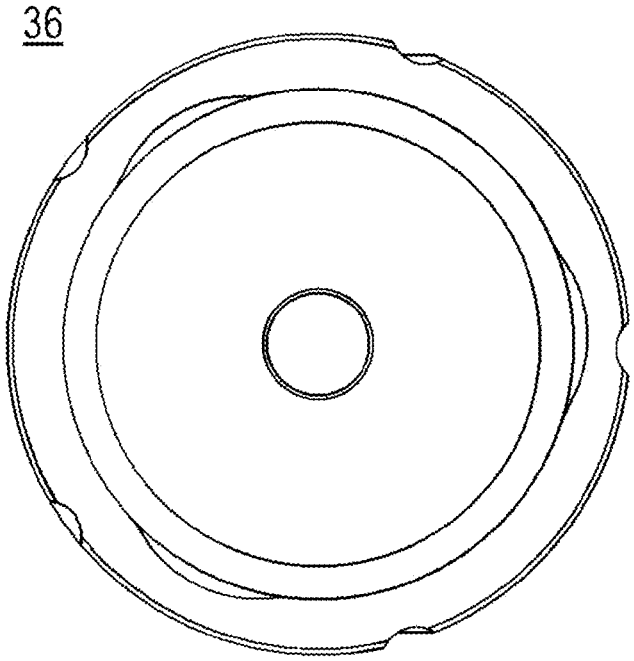

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a latch member" can include two or more such latch members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Described herein with reference to FIGS. 1-9B is an overshot assembly 30 for use within a drilling system 200. In exemplary aspects, the drilling system 200 can comprise a head assembly 10, such as, for example and without limitation, the head assembly depicted in FIGS. 1-3. It is contemplated that the head assembly 10 can be any conventionally known head assembly. However, it is further contemplated that the disclosed overshot assembly 30 can be configured for engagement with known head assemblies following removal of the spearhead assemblies conventionally associated with such head assemblies. Alternatively, in additional exemplary aspects, it is contemplated that the overshot assembly 30 can be configured for engagement with one or more receptacles matingly received within the head assembly 10. In these aspects, it is contemplated that the one or more receptacles can similarly be configured for engagement with at least a portion of the overshot assembly 30.

In exemplary aspects, the head assembly 10 can have a longitudinal axis 12, an outer surface 14, an inner surface 16, and a proximal end 18. In these aspects, it is contemplated that the inner surface 16 of the head assembly 10 can define a central bore 20 of the head assembly. It is further contemplated that the proximal end 18 of the head assembly 10 can define an opening 22 in operative communication with the central bore 20. It is still further contemplated that the inner surface 16 of the head assembly 10 can define an inner diameter 24 of the head assembly. In one exemplary aspect, the head assembly 10 can comprise a retracting case 26 having an inner surface (corresponding to inner surface 16 of the head assembly) that is configured for engagement with a portion of the overshot 30. In this aspect, it is contemplated that the inner surface 16 of the retracting case 26 optionally can define at least one groove 28 extending radially outwardly relative to the longitudinal axis 12 of the head assembly 10. It is further contemplated that the at least one groove 28 can comprise a plurality of grooves. In exemplary aspects, the at least one groove 28 can be spaced from the opening 22 of the proximal end 18 of the head assembly 10 relative to the longitudinal axis 12 of the head assembly. It is contemplated that the retracting case 26 can be an existing retracting case (as is currently known in the art) that is modified to have at least one groove 28 as described herein.

In one aspect, the overshot 30 can have an elongate body 32. Optionally, the elongate body 32 of the overshot 30 can comprise a proximal portion 34 having a longitudinal axis 35 and a distal portion 36 having a longitudinal axis 37. It is contemplated that the proximal portion 34 of the elongate body 32 can comprise one or more conventional overshot components, including, for example and without limitation, a swivel element 33 and a conventional porting and valve configuration. At least a portion of the proximal portion 34 of the elongate body 32, such as, for example and without limitation, the swivel element 33, can be configured for secure engagement and/or coupling with a wireline cable 150 using known mechanisms. In exemplary aspects, the swivel element 33 can comprise an eye bolt having a curved surface configured to matingly receive and engage a loop of the wireline cable 150. In these aspects, the proximal portion 34 of the elongate body 32 can further comprise a grease-lubricated thrust roller bearing configured to permit the eye bolt to swivel in response to excessive twisting in the wireline cable 150 that must be relieved in order to avoid damage to the wireline cable.

In another aspect, the distal portion 36 of the elongate body 32 of the overshot 30 can be configured for receipt within the central bore 20 of the head assembly 10. In this aspect, the distal portion 36 of the elongate body 32 can have a wall 38 and an outer surface 40. It is contemplated that the wall 38 of the distal portion 36 of the elongate body 32 can define a central bore 42 of the elongate body. Optionally, the wall 38 of the distal portion 36 of the elongate body 32 can define at least one proximal radial opening 44 extending from the outer surface 40 to the central bore 42 of the elongate body. It is further contemplated that the wall 38 of the distal portion 36 of the elongate body 32 can define at least one distal radial opening 46 extending from the outer surface 40 to the central bore 42 of the elongate body.

In a further aspect, the overshot 30 can comprise a driving member 50 positioned at least partially within the central bore 42 of the elongate body 32. In this aspect, the driving member 50 can have a longitudinal axis 52. It is contemplated that the driving member 50 can comprise a wedge portion 54 defining at least one driving surface 56. It is further contemplated that each driving surface 56 of the at least one driving surface of the wedge portion 54 can be tapered relative to the longitudinal axis 52 of the driving member 50. For example, as shown in FIGS. 6A-6C and 8-9, it is contemplated that each driving surface 56 can be tapered in a proximal direction toward the proximal portion 34. That is, moving toward the proximal portion 34 of the overshot 30, it is contemplated that each driving surface 56 can be radially inwardly tapered relative to the longitudinal axis 52 of the driving member 50. However, in other optional aspects, it is contemplated that each driving surface 56 can be radially inwardly tapered moving in a distal direction away from proximal portion 34. Optionally, in exemplary aspects, the driving member 50 can comprise a wedge portion 58 spaced from the wedge portion 54 relative to the longitudinal axis 52 of the driving member. In these aspects, it is contemplated that the wedge portion 58 can define at least one driving surface 60, with each driving surface of the at least one driving surface being tapered relative to the longitudinal axis 52 of the driving member 50. For example, as shown in FIGS. 4A, 5A and 8-9, it is contemplated that each driving surface 60 can be radially inwardly tapered moving in a proximal direction toward proximal portion 34. That is, moving toward the proximal portion 34 of the overshot 30, it is contemplated that each driving surface 60 can be radially inwardly tapered relative to the longitudinal axis 52 of the driving member 50. However, in other optional aspects, it is contemplated that each driving surface 60 can be radially inwardly tapered moving in a distal direction away from proximal portion 34.

In additional aspects, the distal portion 34 of the overshot 30 can comprise at least one latch member 70 configured for movement about and between a latched position and a retracted position. In these aspects, the at least one latch member 70 can be configured for receipt within the at least one distal radial opening 46 of the elongate body 32. It is contemplated that each latch member 70 of the at least one latch member can be positioned in engagement with a corresponding driving surface 56 of the wedge portion 54 of the driving member 50. It is contemplated that each latch member 70 of the at least one latch member can be at least one of a ball, a roller, a cylinder, a cam-shaped element, and the like.

Upon movement of the driving member 50 in a first direction substantially parallel to the longitudinal axis 52 of the driving member (such that a distal (maximal diameter) portion of the wedge portion 54 contacts the at least one latch member 70), it is contemplated that the at least one driving surface 56 of the wedge portion 54 of the driving member can be configured to wedge the at least one latch member 70 between the inner surface of the head assembly 10 and the at least one driving surface 56 such that the overshot 30 contacts the inner surface 16 of the head assembly. Thus, it is contemplated that the inner surface 16 of the head assembly 10 can be configured for secure engagement with the at least one latch member 70 of the overshot 30 when the at least one latch member is positioned in the latched position. Upon secure engagement between the at least one latch member 70 of the overshot 30 and the inner surface 16 of the head assembly 10 as described herein, it is contemplated that the head assembly can be operatively coupled to the overshot such that movement of the overshot results in a corresponding movement of the head assembly. For example, following secure engagement between the at least one latch member 70 and the inner surface 16 of the head assembly 10, it is contemplated that movement of the overshot 30 in one or more directions sufficient to exit a drilling formation can cause movement of the head assembly in the same directions such that the overshot and the head assembly can be removed from the drilling formation. Optionally, it is contemplated that the at least one latch member 70 of the overshot 30 can securely engage the inner surface 16 of the head assembly 10 such that the elongate body 32 cannot rotate relative to the head assembly.

In additional aspects, when the at least one latch member 70 of the overshot is positioned in the retracted position, it is contemplated that the at least one latch member can define an outer diameter 72 of the distal portion 36 of the overshot 30 that is less than the inner diameter 24 of the head assembly 10. In further aspects, it is contemplated that the at least one latch member 70 can be biased toward the latched position. In exemplary aspects, the at least one latch member 70 can be spring-loaded toward the latched position. In these aspects, it is contemplated that the driving member can be spring-loaded toward an axial position in which the at least one latch member is urged toward the latched position (by wedge portion 54). Upon entry of the distal portion 36 of the overshot 30 into the opening 22 and central bore 20 of the head assembly 10, it is contemplated that the inner surface 16 of the retracting case 26 and/or the proximal end 18 of the head assembly can be configured to force the at least one latch member 70 into the retracted position (from the latched position). In further exemplary aspects, the at least one groove 28 can be configured to securely receive the at least one latch member 70 of the overshot 30 when the at least one latch member is positioned in the latched position. In still further exemplary aspects, it is contemplated that the proximal end 18 of the head assembly 10 can be configured to abut a portion of the overshot 30 when the at least one latch member 70 is received within the at least one groove 28 of the retracting case 26.

Upon movement of the driving member 50 in a second direction opposed to the first direction and substantially parallel to the longitudinal axis 52 of the driving member (such that the distal (maximal diameter) portion of the wedge portion 54 is disengaged from the at least one latch member 70), the at least one latch member 70 can be retracted relative to the inner surface 16 of the head assembly 10 such that the at least one latch member 70 disengages the inner surface of the head assembly.

In other exemplary aspects, the overshot 30 can further comprise at least one locking member 80 configured for receipt within the at least one proximal radial opening 44 of the elongate body 32. In these aspects, it is contemplated that each locking member 80 of the at least one locking member can be positioned in engagement with a corresponding driving surface 60 of wedge portion 58. It is further contemplated that the wedge portion 58 can be spaced from the wedge portion 54 relative to the longitudinal axis 52 of the driving member such that wedge portion 58 is positioned external to the head assembly 10 when the at least one latch member 70 is engaged with the inner surface 16 of the head assembly. In various aspects, it is contemplated that each locking member 80 of the at least one locking member can be at least one of a ball, a roller, a cylinder, a cam-shaped element, and the like.

In further aspects, the overshot 30 can comprise a locking sleeve 90 having an inner surface 92 configured for engagement with the outer surface 40 of the distal portion 36 of the elongate body 32. In these aspects, the locking sleeve 90 can be configured for rotational movement relative to the outer surface 40 of the elongate body 32 about and between a locked position and an unlocked position. When the locking sleeve 90 is in the locked position, it is contemplated that the at least one driving surface 60 of wedge portion 58 can be configured to wedge the at least one locking member 80 between the inner surface 92 of the locking sleeve 90 and the at least one driving surface 60 of wedge portion 58 such that the elongate body 32 is prevented from rotating relative to the locking sleeve 90. When the locking sleeve 90 is in the unlocked position, it is contemplated that the elongate body 32 can be configured for rotation relative to the locking sleeve.

Figure 5A:
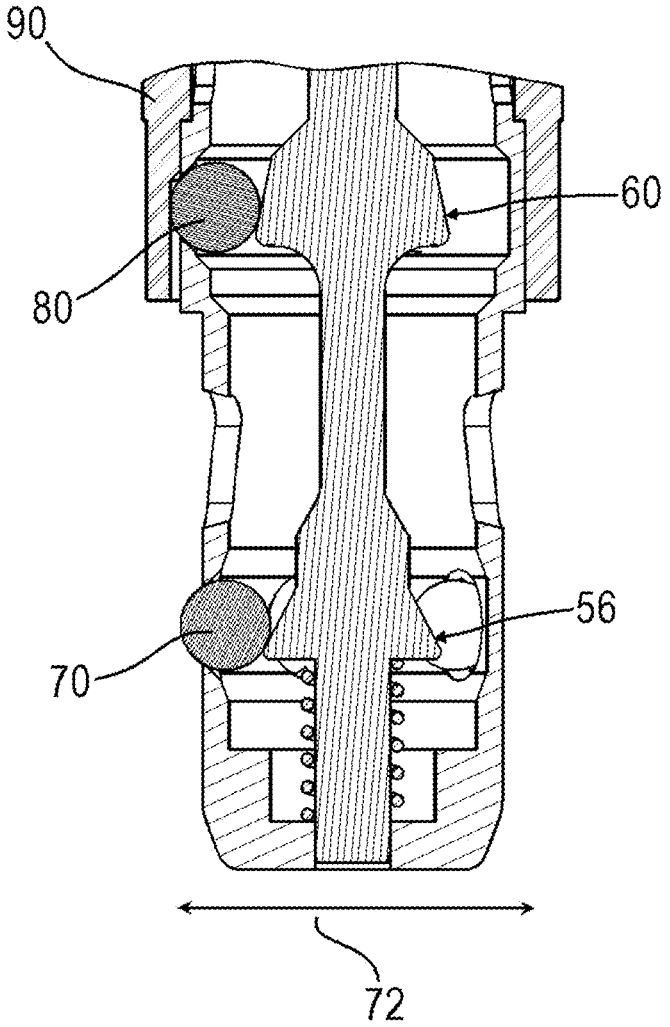
FIG. 5A is a close-up cross-sectional front view of the distal portion of the elongate body of an overshot assembly, with latching and locking elements in latched and locked positions as described herein.
Figure 5B:
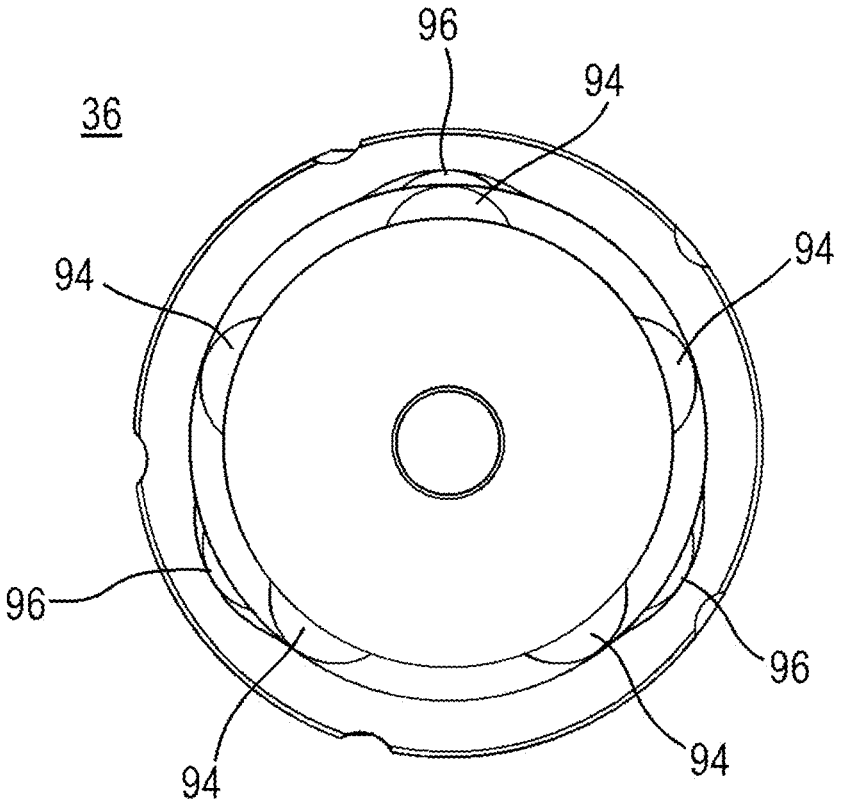
FIG. 5B is an isolated top view of the locking sleeve of the overshot assembly depicted in FIG. 5A.
Figure 6A:
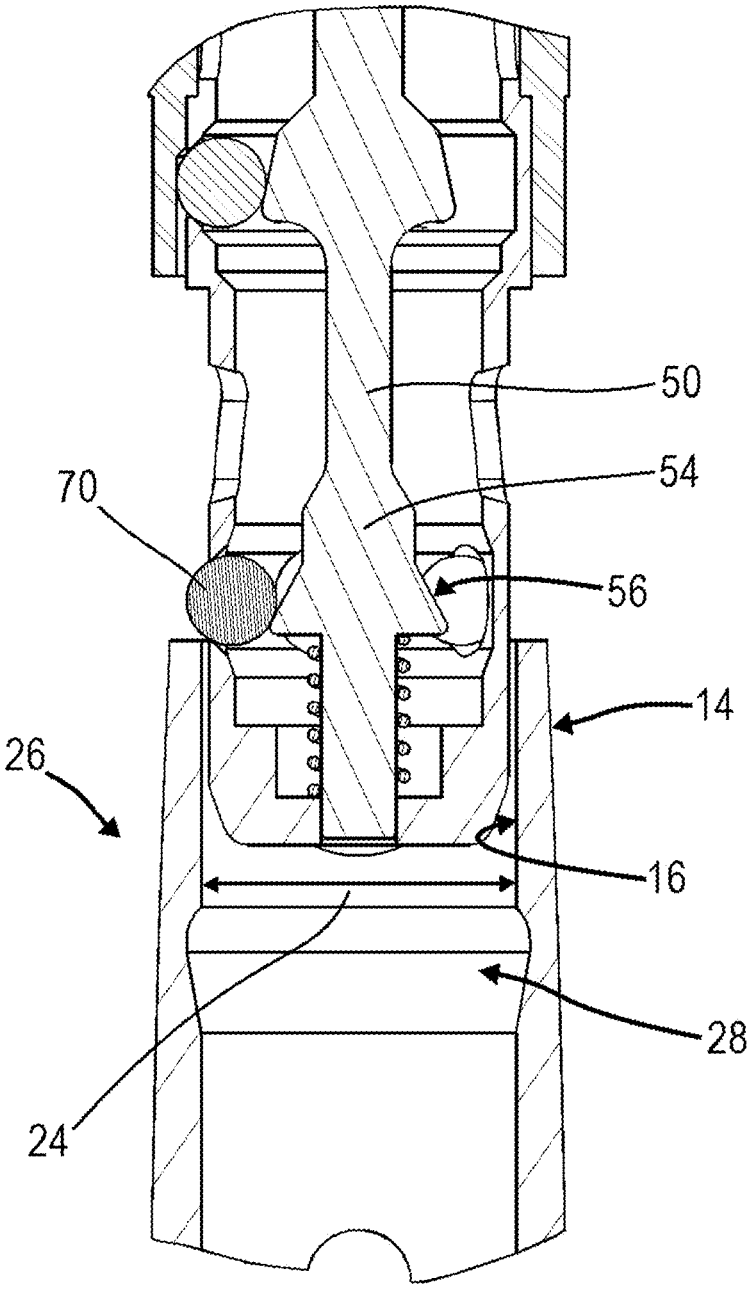
FIGS. 6A-6C are close-up cross-sectional front views of an elongate body of an exemplary overshot assembly as the overshot assembly is inserted and engaged within a head assembly as described herein.
Figure 6B:
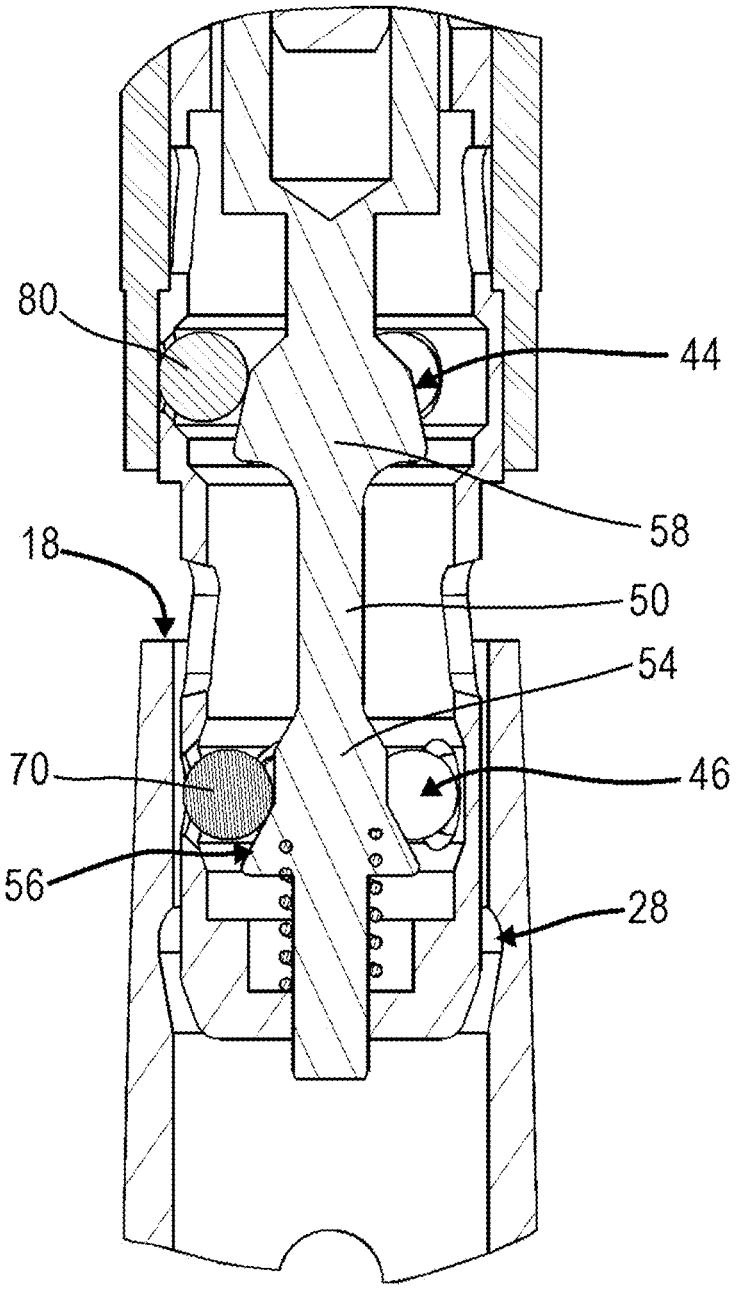
Figure 6C:
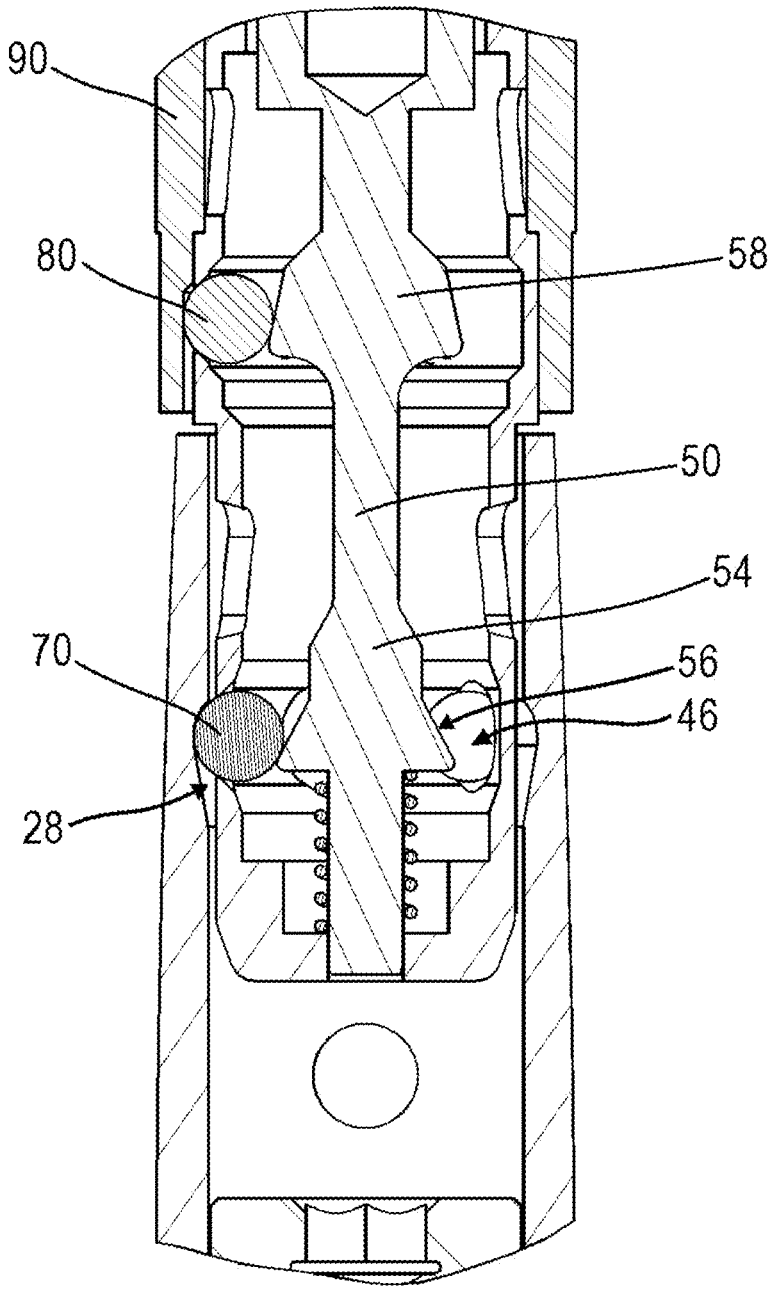

In use, and with reference to FIG. 5A, it is contemplated that the wedge portions 54, 58 and the latching and locking members 70, 80 can be configured and positioned such that when the wedge portion 54 effects positioning of the latching elements 70 in the latched position, the wedge portion 58 can effect positioning of the locking elements 80 in the locked position. Similarly, and with reference to FIG. 4A, it is contemplated that the wedge portions 54, 58 and the latching and locking elements 70, 80 can be configured and positioned such that when the wedge portion 54 is advanced longitudinally such that the latching elements return to the retracted position, the wedge portion 58 will also be advanced longitudinally, and the locking elements 80 will be returned to the retracted position. It is contemplated that the latching elements 70 can be sized to protrude beyond the elongate body 32 and securely engage the inner surface 16 of the head assembly 10 while maintaining secure engagement with the elongate body. Thus, it is contemplated that, upon engagement between the latching elements 70 and the inner surface 16 of the head assembly 10, the latching elements (and the head assembly 10) can be configured to support loads applied by the overshot assembly 30.

Figure 8:
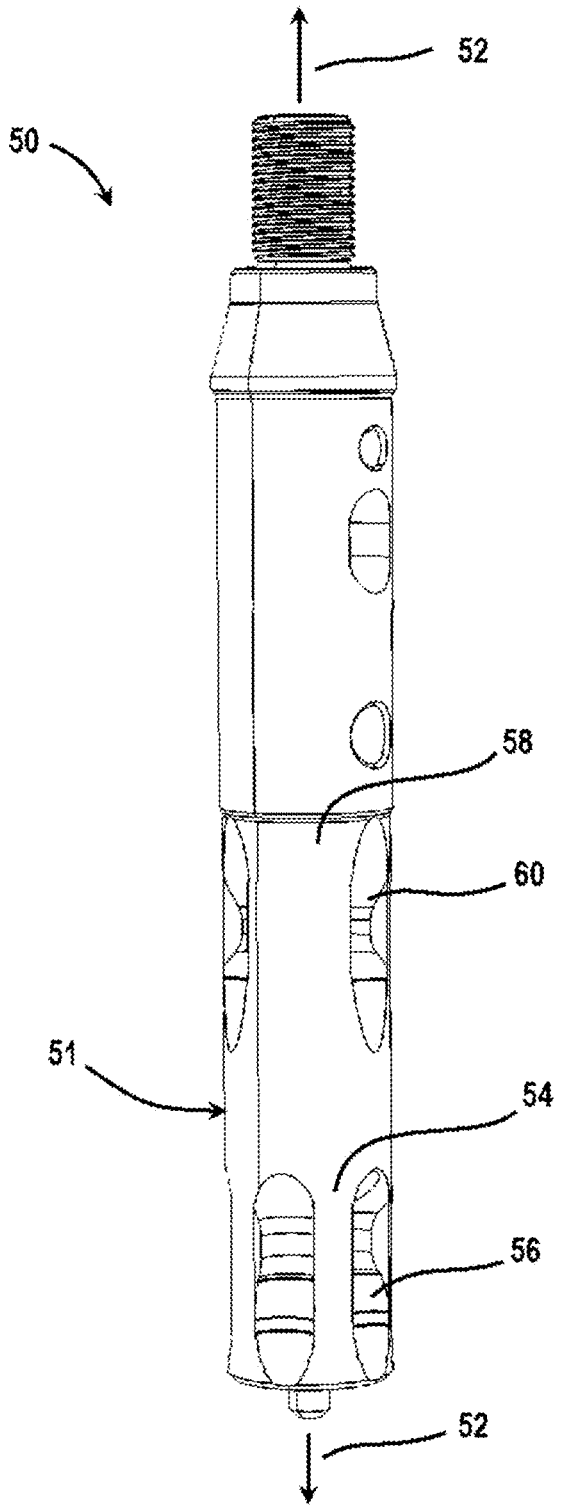
FIG. 8 depicts an exemplary driving member having a plurality of inwardly tapered driving surfaces as disclosed herein.

In operation, it is contemplated that the wedge portions 54, 58 can be sized and shaped to accommodate movement of the latching and locking elements 70, 80 as described herein. Optionally, in some exemplary aspects, as shown in FIGS. 3, 4A, 5A, and 6A-6C, it is contemplated that each wedge portion 54, 58 can have outer surfaces that define an inward taper relative to the longitudinal axis 12 of the head assembly 10 as further described herein. In these aspects, it is contemplated that the wedge portions 54, 58 can optionally have a substantially circular cross-sectional profile relative to the longitudinal axis 12 of the head assembly. It is further contemplated that the wedge portions can have shape substantially corresponding to a tapered cone. Optionally, the tapered cone can have a varying tapered profile relative to the longitudinal axis 52 of the driving member 50. In other exemplary aspects, as shown in FIG. 8, it is contemplated that the driving member 50 can comprise an elongate driving member 50 defining a substantially cylindrical outer surface 51. In these aspects, it is contemplated that the wedge portions 54, 58 of the driving member 50 can correspond to respective portions of the outer surface 51 of the elongate driving member 50. It is further contemplated that the driving surfaces 56, 60 defined by each wedge portion can correspond to grooves having an inwardly tapered profile relative to the longitudinal axis 52 of the driving member 50. It is still further contemplated that the grooves corresponding to the driving surfaces 56 can comprise a plurality of circumferentially spaced grooves positioned within wedge portion 54, while the grooves corresponding to the driving surfaces 60 can comprise a plurality of circumferentially spaced grooves positioned within wedge portion 58. It is still further contemplated that each latching or locking member 70, 80 can be positioned within a respective groove of the wedge portions 54, 58 and be configured for movement within the groove during operation of the head assembly 10 as disclosed herein.

Figure 9A:
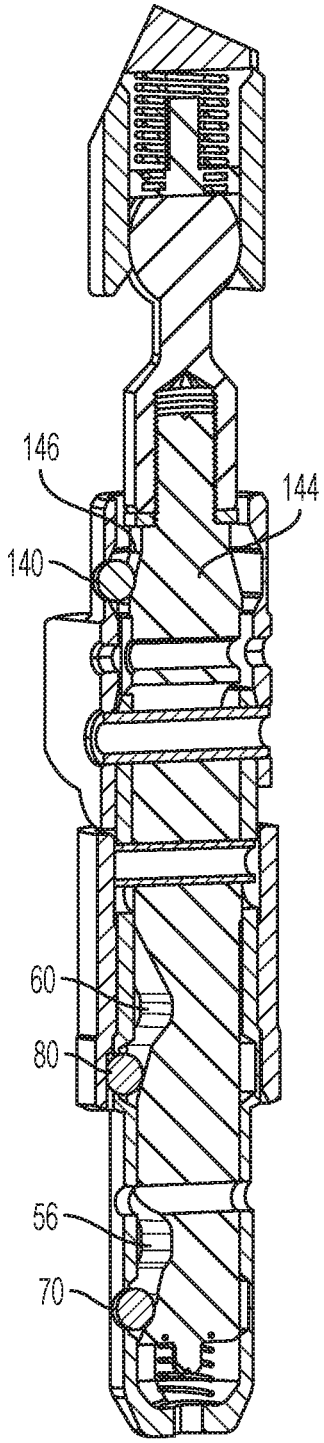
FIG. 9A depicts an exemplary release mechanism for an overshot assembly as disclosed herein.
Figure 9B:
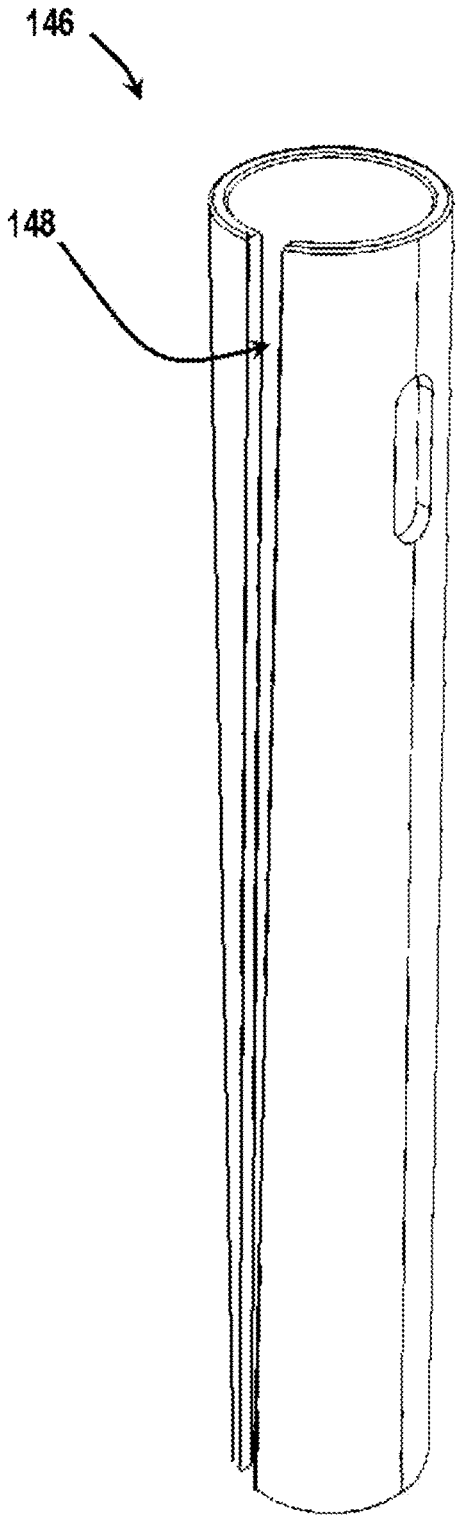
FIG. 9B depicts an exemplary release sleeve of the release mechanism of FIG. 9A.

Optionally, as shown in FIGS. 9A-9B, it is contemplated that the head assembly 10 can comprise a release mechanism operatively that permits release of a core barrel in the event the core barrel becomes stuck and/or jammed during drilling operations. In exemplary aspects, the release mechanism can comprise a set of engagement members 140 operatively coupled to a distal portion 142 of the drive member 50 (for example, the portion of the drive member 50 most proximate a pivot joint element as further disclosed herein) and axially spaced from the latching and locking members 70, 80 relative to the longitudinal axis 52 of the drive member. In these aspects, it is contemplated that the engagement members 140 can be configured for movement between a retracted position and a deployed position. It is further contemplated that the engagement members can comprise at least one of a ball, a roller, a cam-shaped element, and the like. It is still further contemplated that the distal portion 142 of the drive member 50 can define a plurality of driving surfaces 144 configured for engagement with the engagement members 140. In exemplary aspects, it is contemplated that the driving surfaces 144 can be radially tapered moving relative to the longitudinal axis 52 of the driving member 50 such that axial movement of the driving member 50 can effect radial movement of the engagement members 140 between the retracted position and the deployed position. In these aspects, it is contemplated that the driving surfaces 144 can be radially tapered in either direction relative to the longitudinal axis 52 of the driving member 50, depending upon the particular coupling arrangement (pinned, slotted, etc.) of the various components of the drilling system 200. Thus, in some aspects, it is contemplated that the driving surfaces 144 can optionally be radially inwardly tapered moving toward the proximal portion 34 of the elongate body 32 relative to the longitudinal axis 52 of the driving member 50. Alternatively, in other optional aspects, it is contemplated that the driving surfaces 144 can optionally be radially inwardly tapered moving away from the proximal portion 34 of the elongate body 32 relative to the longitudinal axis 52 of the driving member 50.

In additional exemplary aspects, as shown in FIG. 9B, it is contemplated that the release mechanism can further comprise a release sleeve 146 defining a longitudinal slot 148. In these aspects, it is contemplated that a portion of the wireline cable can be passed through the slot 148 of the release sleeve 146 such that the release sleeve substantially circumferentially surrounds the wireline cable. From this position, it is contemplated that the release sleeve 146 can be axially advanced toward the plurality of engagement members 140 until the sleeve lands on the outermost edges of the engagement members (with the engagement members positioned in the deployed position). It is further contemplated that, due to the weight of the release sleeve 146, the release sleeve can continue its axial movement relative to the longitudinal axis 52 of the drive member 50 (and away from the proximal portion 34 of the elongate body 32) until the release sleeve effects inward radial movement of the engagement elements 140 toward their retracted position and passes over the engagement elements.

In use, it is contemplated that when the overshot 30 is fully seated within a core barrel assembly as disclosed herein, the overshot can be axially advanced such that the latching and/or locking members 70, 80 are positioned in their retracted (un-latched and/or un-locked) positions. As used herein, the term "fully seated" refers to a position in which there is substantially no wireline cable retraction tension and the overshot 30 is seated by gravity alone or by pump-in fluid pressure alone, thereby permitting the latch members 70 to be driven into their retracted/un-latched position. Once wireline retraction begins, the overshot 30 is lifted slightly, and the latch members 70 are substantially adjacent to the latch groove in the retracting case, it is contemplated that the latch members can be returned by a spring load into their default deployed/latched position.

It is contemplated that the engagement members 140 can be operatively coupled to the latching and/or locking members 70, 80 through the driving member 50 such that the engagement members are positioned in a deployed position (for example, a radially extended position relative to the longitudinal axis 52 of the drive member 50) when the latching and/or locking members 70, 80 are positioned in a latched or locked position. It is further contemplated that the engagement members 140 can be operatively coupled to the latching and/or locking members 70, 80 such that, upon retraction of the engagement members, the latching and/or locking members 70, 80 are likewise radially retracted toward their respective retracted positions. It is still further contemplated that retraction of the engagement members 140, latching members 70, and/or locking members 80 can be configured to permit release of a core barrel. It is further contemplated that, after the release sleeve 146 is passed over the engagement members 140 as disclosed herein, the release sleeve can remain positioned such that the engagement members 140 are incapable of outward radial movement toward the deployed position while the overshot 30 is lifted out of the core barrel assembly.

In exemplary aspects, the inner surface 92 of the locking sleeve 90 can define at least one groove 94 configured to receive at least a portion of a respective locking member 80 when the locking sleeve 90 is in the locked position. It is contemplated that the inner surface 92 of the locking sleeve 90 can further comprise at least one camming surface 96 configured for engagement with a respective locking member 80 during rotation (twisting) of the locking sleeve 90 such that the locking members of the at least one locking member are driven into the grooves 94 due to the biasing force of the driving member 50. In exemplary aspects, the at least one camming surface 96 can be configured to provide bi-directional camming action; however, it is contemplated that uni-directional camming surfaces can also be used. In use, it is contemplated that the locking sleeve 90 can permit one-handed manual locking of the locking sleeve relative to the elongate body 32 and wedge portion 58. It is further contemplated that such one-handed manual locking can be used to position the at least one locking member 80 in the locked position and to position the at least one latch member in the latched position prior to insertion of the overshot assembly 30 into a drill hole. It is still further contemplated that the twisting action of the locking sleeve 90 can be isolated from the axial forces experienced during tripping and/or external handling of the overshot assembly 30 (and head assembly 10). In some aspects, the latching members 70 and/or locking members 80 can protrude only a limited distance from the elongate body 32. In these aspects, given the tight radial fits required for operation of the latching and locking members 70, 80 as described herein, it is contemplated that the latching members, locking members, the elongate body 32, and/or the head assembly 10 can comprise corrosion and/or wear-resistant materials and/or be treated with corrosion and/or wear-resistant coatings or treatments.

Optionally, in additional exemplary aspects, it is contemplated that the overshot 30 can further comprise a pivot joint element 100 positioned between and coupled to the proximal portion 34 and the distal portion 36 of the overshot. In these aspects, it is contemplated that the distal portion 36 of the overshot 30 can be configured for pivotal movement in at least two planes relative to the proximal portion 34 of the overshot. In exemplary aspects, it is contemplated that the distal portion 36 of the overshot 30 can be configured for pivotal movement in three perpendicular planes relative to the proximal portion 34 of the overshot.

In one aspect, the proximal portion 34 of the overshot 30 can have an inner surface 62 that defines a chamber 64. In another aspect, the distal portion 36 of the overshot 30 can have an inner surface 66 that defines a central bore 68. In exemplary aspects, the pivot joint element 100 can further comprise a first end portion 102 configured for receipt within the chamber 64 of the proximal portion 34 of the overshot 30. In these aspects, the pivot joint element 100 can further comprise a second end portion 104 configured for secure attachment to the distal portion 36 of the overshot 30 upon receipt of the second end portion within the central bore 68 of the distal portion 36 of the overshot.

In exemplary aspects, it is contemplated that the proximal portion 34 of the overshot 30 can comprise an engagement surface 63 positioned in communication with the chamber 64 of the proximal portion and oriented substantially perpendicularly relative to the longitudinal axis 35 of the proximal portion of the overshot. In exemplary aspects, the engagement surface 63 can be defined by a plunger positioned in communication with the chamber 64. In these aspects, it is contemplated that the plunger (and the engagement surface 63) can comprise bearing and wear-resistant materials, such as for example and without limitation, lubricated nylon, brass, and the like. It is further contemplated that the plunger (and the engagement surface 63) can be treated with a surface coating or treatment that is configured to promote easy relative movement and wear resistance. In these aspects, the first end portion 102 of the pivot joint element 100 can comprise a ball joint 106 having a substantially flat end surface 108. Upon positioning of the pivot joint element 100 such that the end surface 108 of the first end portion 102 is substantially flush with the engagement surface 63 of the proximal portion 34 of the overshot 30, it is contemplated that the longitudinal axes 35, 37 of the proximal and distal portions 34, 36 of the overshot 30 can be substantially axially aligned.

In additional aspects, it is contemplated that the pivot joint element 100 can be configured to pivot in three perpendicular planes 130*a*, 130*b*, 130*c* relative to the proximal portion 34 of the overshot 30 such that the longitudinal axis 37 of the distal portion 36 of the overshot is positioned at an orientation angle 69 relative to the longitudinal axis 35 of the proximal portion 34 of the overshot. Optionally, in use, it is contemplated that pivoting of the distal portion 36 of the overshot 30 can effect movement of the at least one latch element 70 (and the at least one locking element 80) from the latched position to the retracted position.

In still additional aspects, it is contemplated that the pivot joint element 100 can be configured to pivot in a first plane 130*a* relative to the proximal portion 34 of the overshot 30 such that the longitudinal axis 37 of the distal portion 36 of the overshot is substantially perpendicular to the longitudinal axis 35 of the proximal portion of the overshot. Thus, in these aspects, it is contemplated that the orientation angle 69 of the longitudinal axis 37 of the distal portion 36 of the overshot 30 can range from about 0 degrees to about 90 degrees within the first plane 130*a*. In further exemplary aspects, the inner surface 62 of the proximal portion 34 of the overshot 30 can define a slot 65 configured to receive the pivot joint element 100 when the longitudinal axis 37 of the distal portion 36 of the overshot is positioned substantially perpendicularly relative to the longitudinal axis 35 of the proximal portion of the overshot. It is contemplated that the inner surface 62 of the proximal portion 34 of the overshot and the slot 65 can be positioned and shaped such that the inner surface 62 and the slot cooperate to restrict rotation of the distal portion 36 within the first plane 130*a* beyond a selected angle, such as, for example and without limitation, 90 degrees. For example, as shown in FIG. 7C, when the distal portion 36 of the overshot 30 is positioned substantially perpendicularly relative to the proximal portion 34 of the overshot within the first plane 130*a*, a rounded portion of the ball joint 106 abuts a portion of the engagement surface 63 while the inner surface 62 engages a portion of the end surface 108 of the ball joint and an intermediate portion of the pivot joint (positioned distal to the ball joint) is engaged within the slot 65. It is contemplated that the chamber 64 and the slot 65 can be sized and shaped to conform to the cross-sectional shape of the shaft portion of pivot joint element 100.

In exemplary aspects, the longitudinal axis 37 of the distal portion 36 of the overshot 30 can have an orientation angle 69 within each respective plane 130. In these aspects, it is contemplated that the orientation angle 69 of the longitudinal axis 37 of the distal portion 36 of the overshot 30 can range from about 0 degrees to about 45 degrees within the second and third planes 130*b*, 130*c*. It is contemplated that the inner surface 62 of the proximal portion 34 of the overshot and the engagement surface 63 can be positioned and shaped such that the inner surface 62 and the engagement surface cooperate to restrict rotation of the distal portion 36 within the second and third planes 130*b*, 130*c* beyond a selected angle, such as, for example and without limitation, 45 degrees. For example, as shown in FIG. 7B, when the distal portion 36 of the overshot 30 is positioned at about the selected angle (e.g., about 45 degrees) relative to the proximal portion 34 of the overshot within the second or third planes 130*b*, 130*c*, an edge portion of the end surface 108 of the ball joint 106 can engage a portion of the engagement surface 63 while the inner surface 62 engages at least one of: (a) a portion of the end surface 108 of the ball joint; (b) an intermediate portion of the pivot joint element 100 (positioned distal to the ball joint); and (c) a rounded portion of the ball joint.

Figure 7A:
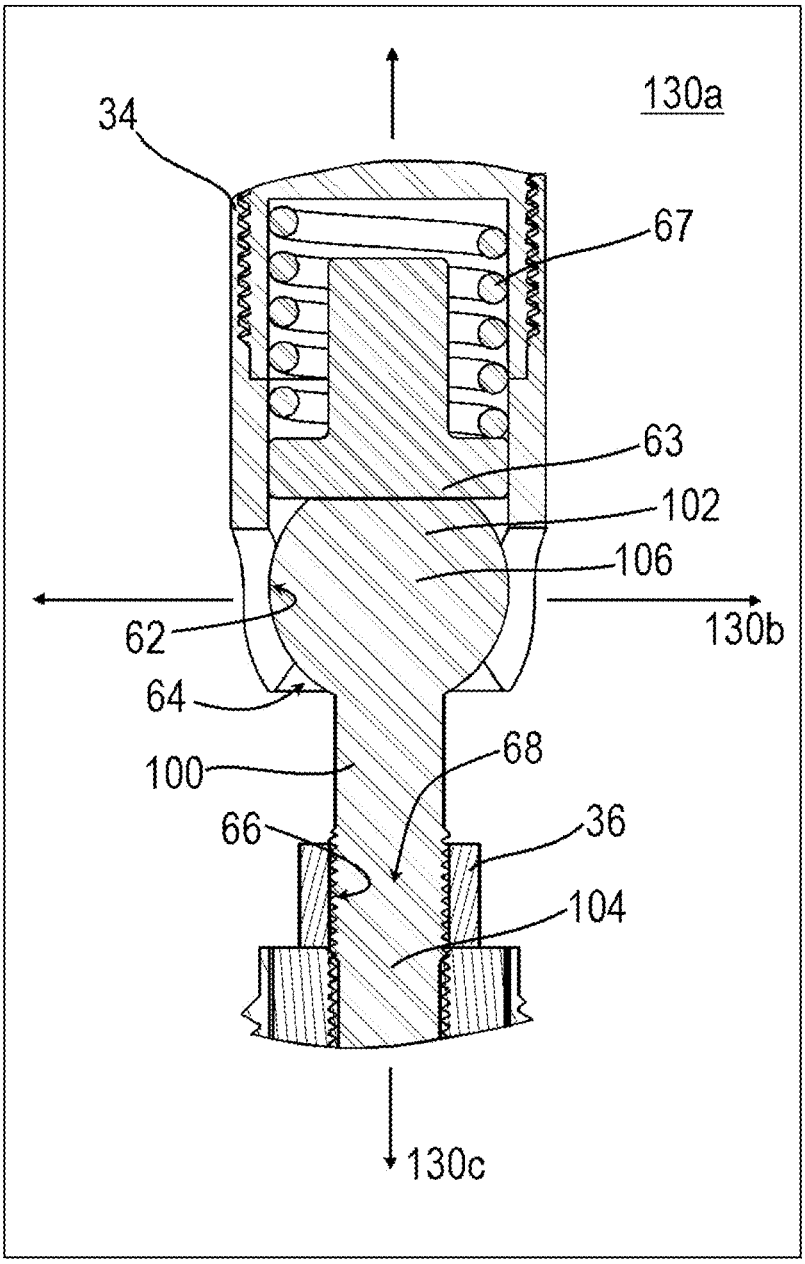
FIGS. 7A-7C depict the operation of a pivot joint element of an exemplary overshot assembly as described herein.
Figure 7B:
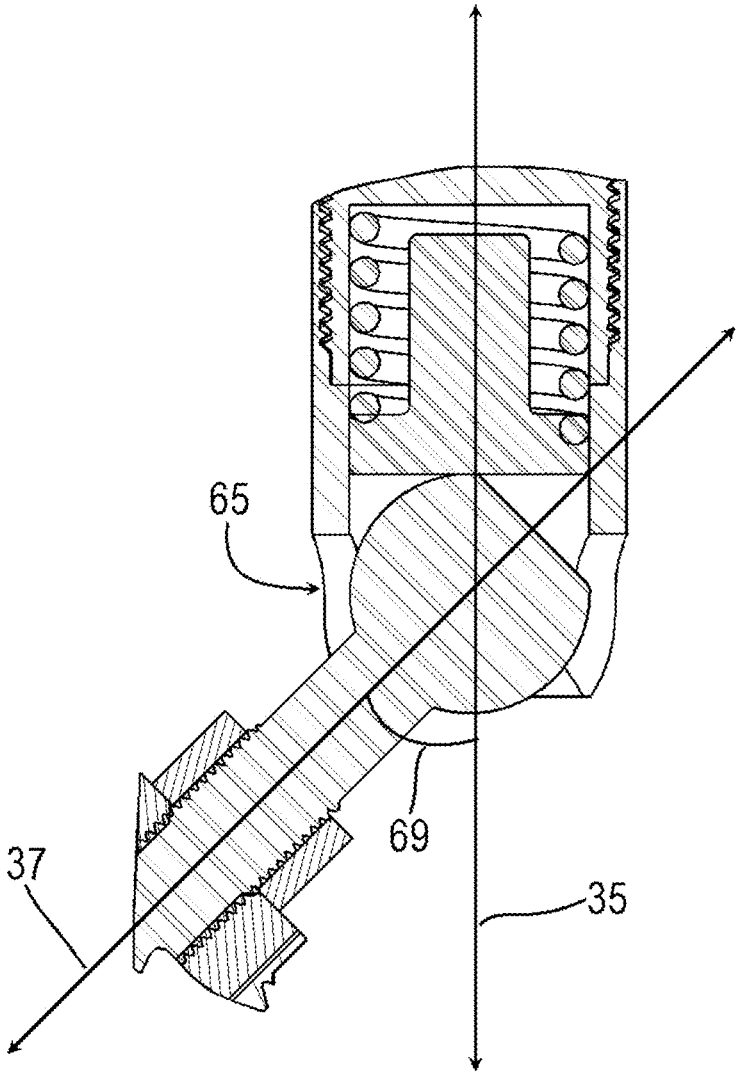
Figure 7C:
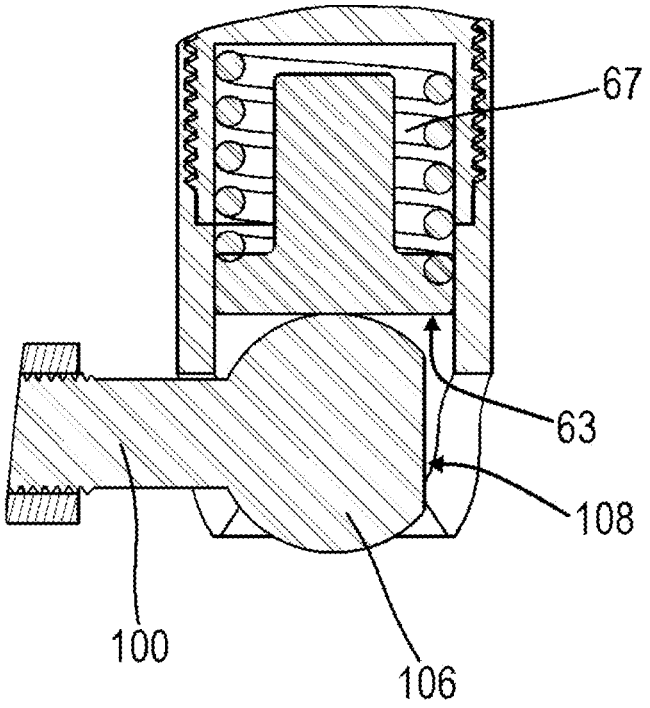

In exemplary aspects, as shown in FIGS. 7A-7C, the engagement surface 63 can be defined by an elongate element that is spring-loaded by a spring 67. In these aspects, it is contemplated that the spring 67 can be configured to bias the engagement surface 63 toward the chamber 64. It is further contemplated that the engagement surface 63 can be configured for axial translation relative to the longitudinal axis 35 of the proximal portion 34 of the overshot 30 upon application of a force sufficient to overcome the biasing force applied by the spring 67. Thus, for example, in order to accomplish rotation of the distal portion 36 of the overshot 30 within the first plane 130*a* relative to the proximal portion 34 of the overshot, it is contemplated that the ball joint 106 must first apply an axial force to the engagement surface 63 such that the engagement surface translates a sufficient distance to permit rotation of the ball joint 106 within the chamber 64.

It is contemplated that, by eliminating the spearhead assembly required in conventional overshot systems, the disclosed overshot assembly 30 and head assembly 10 (and retracting case 26) can comprise more robust and reliable materials than conventional overshot systems. Moreover, the investment castings and elongated geometries conventionally used in the components of overshot systems are associated with large dimensional variance, rough surfaces, mechanical property variance, material flaws, inclusion of foreign materials, and heat treatment limitations. Through the elimination of these investment castings and associated elongated geometries, it is contemplated that the disclosed overshot assembly 30 and head assembly 10 can comprise machined and/or formed materials having reduced dimensional variance, thereby permitting tighter fits (due to more accurate production mechanisms) and a greater range of material properties and surface treatments. For example and without limitation, it is contemplated that the latch members 70 and/or locking members 80 can comprise bearing grade hardened stainless steel rollers as are known in the art.

It is further contemplated that, with the elimination of the spearhead assembly, the disclosed drilling system 200 provides a more compact design with a smaller number of parts, thereby ensuring improved reliability.

In use, it is contemplated that the disclosed pivot joint element 100 can permit the overshot 30 to function at a wide range of angles and orientations, thereby eliminating the limitations of conventional spearhead pivot assemblies. More particularly, it is contemplated that the disclosed pivot joint element 100, which permits initial pivoting in 45 degrees in all orientations, eliminates the conventional requirement that the plane in which the overshot 30 pivots correspond to the axial orientation of the overshot. As described herein, only when an operator decides to pivot beyond 45 degrees (to 90 degrees) does the pivoting action need to complement the orientation of the overshot 30. The disclosed pivot joint element 100 therefore reduces the risk of overloading, which often occurred in conventional spearhead pivots when operators failed to orient their initial pivoting action with the spearhead.

Exemplary Aspects

In one exemplary aspect, a drilling system for use in a drilling formation is provided. The drilling system can comprise a head assembly having a longitudinal axis, an outer surface, an inner surface, and a proximal end, the inner surface of the head assembly defining a central bore, the proximal end of the head assembly defining an opening in operative communication with the central bore. The drilling system can further comprise an overshot having a distal portion configured for receipt within the central bore of the head assembly, the distal portion of the overshot comprising at least one latch member configured for movement about and between a latched position and a retracted position. The inner surface of the head assembly can be configured for secure engagement with the at least one latch member of the overshot when the at least one latch member is positioned in the latched position. Upon secure engagement between the at least one latch member of the overshot and the inner surface of the head assembly, the head assembly can be operatively coupled to the overshot such that movement of the overshot results in a corresponding movement of the head assembly.

In another exemplary aspect, the inner surface of the head assembly can define an inner diameter of the head assembly, and the at least one latch member of the overshot can be positioned in the retracted position, the at least one latch member defining an outer diameter of the distal portion of the overshot that is less than the inner diameter of the head assembly.

In another exemplary aspect, the head assembly can comprise a retracting case having an inner surface that is configured for engagement with the at least one latch member of the overshot.

In another exemplary aspect, the at least one latch member can be biased toward the latched position.

In another exemplary aspect, upon entry of the distal portion of the overshot into the opening and central bore of the head assembly, the inner surface of the retracting case can be configured to force the at least one latch member into the retracted position.

In another exemplary aspect, the inner surface of the retracting case can define at least one groove extending radially outwardly relative to the longitudinal axis of the head assembly, the at least one groove being spaced from the opening of the proximal end of the head assembly relative to the longitudinal axis, wherein the at least one groove is configured to securely receive the at least one latch member of the overshot when the at least one latch member is positioned in the latched position.

In another exemplary aspect, the proximal end of the head assembly can be configured to abut a portion of the overshot when the at least one latch member is received within the at least one groove of the retracting case.

In one exemplary aspect, an overshot assembly is provided for operative coupling to a head assembly within a drilling system. The head assembly can have a proximal end defining an opening and an inner surface defining a central bore of the head assembly. The overshot assembly can comprise an elongate body having a wall and an outer surface, the wall of the elongate body defining a central bore of the elongate body and at least one distal radial opening extending from the outer surface to the central bore of the elongate body. The overshot assembly can further comprise a driving member positioned at least partially within the central bore of the elongate body, the driving member having a longitudinal axis and a first wedge portion, the first wedge portion defining at least one driving surface, each driving surface of the at least one driving surface of the first wedge portion being tapered relative to the longitudinal axis of the driving member. The overshot assembly can further comprise at least one latch member configured for receipt within the at least one distal radial opening of the elongate body, each latch member of the at least one latch member being positioned in engagement with a corresponding driving surface of the first wedge portion of the driving member. Upon movement of the driving member in a first direction substantially parallel to the longitudinal axis of the driving member, the at least one driving surface of the driving member can be configured to wedge the at least one latch member between the inner surface of the head assembly and the at least one driving surface such that the overshot securely engages the inner surface of the head assembly.

In another exemplary aspect, upon movement of the driving member in a second direction opposed to the first direction and substantially parallel to the longitudinal axis of the driving member, the at least one latch member can be retracted relative to the inner surface of the head assembly.

In another exemplary aspect, the driving member can have a second wedge portion spaced from the first wedge portion relative to the longitudinal axis of the drive member such that the second wedge portion is positioned external to the head assembly when the at least one latch member is engaged with the inner surface of the head assembly, the second wedge portion defining at least one driving surface, each driving surface of the at least one driving surface of the second wedge portion being tapered relative to the longitudinal axis of the driving member.

In another exemplary aspect, the elongate body can further define at least one proximal radial opening extending from the outer surface of the elongate body to the central bore of the elongate body, wherein the overshot further comprises: at least one locking member configured for receipt within the at least one proximal radial opening of the elongate body, each locking member of the at least one locking member being positioned in engagement with a corresponding driving surface of the second wedge portion; and a locking sleeve having an inner surface configured for engagement with the outer surface of at least a portion of the elongate body, the locking sleeve being configured for rotational movement relative to the outer surface of the elongate body about and between a locked position and an unlocked position.

In another exemplary aspect, in the locked position, the at least one driving surface of the second wedge portion can be configured to wedge the at least one locking member between the inner surface of the locking sleeve and the at least one driving surface of the second wedge portion such that the elongate body is prevented from rotating relative to the locking sleeve, and wherein, in the unlocked position, the elongate body is configured for rotation relative to the locking sleeve.

In one exemplary aspect, an overshot assembly is provided for operative coupling to a head assembly within a drilling system. The head assembly can have a proximal end defining an opening and an inner surface defining a central bore of the head assembly. The overshot assembly can comprise an elongate body having a wall and an outer surface, the wall of the elongate body defining a central bore of the elongate body and at least one proximal radial opening extending from the outer surface to the central bore of the elongate body. The overshot assembly can further comprise a driving member positioned at least partially within the central bore of the elongate body, the driving member having a longitudinal axis and a first wedge portion, the first wedge portion defining at least one driving surface, each driving surface of the at least one driving surface of the first wedge portion being tapered relative to the longitudinal axis of the driving member. The overshot assembly can further comprise at least one locking member configured for receipt within the at least one proximal radial opening of the elongate body, each locking member of the at least one locking member being positioned in engagement with a corresponding driving surface of the first wedge portion of the driving member. The overshot assembly can further comprise a locking sleeve having an inner surface configured for engagement with the outer surface of at least a portion of the elongate body, the locking sleeve being configured for rotational movement relative to the outer surface of the elongate body about and between a locked position and an unlocked position. In the locked position, the at least one driving surface of the driving member can be configured to wedge the at least one locking member between the inner surface of the locking sleeve and the at least one driving surface such that the elongate body is prevented from rotating relative to the locking sleeve. In the unlocked position, the elongate body can be configured for rotation relative to the locking sleeve.

In another exemplary aspect, the driving member can have a second wedge portion spaced from the first wedge portion relative to the longitudinal axis of the drive member, the second wedge portion defining at least one driving surface, each driving surface of the at least one driving surface of the second wedge portion being tapered relative to the longitudinal axis of the driving member.

In another exemplary aspect, the elongate body can further define at least one distal radial opening extending from the outer surface of the elongate body to the central bore of the elongate body, the overshot assembly further comprising: at least one latch member configured for receipt within the at least one distal radial opening of the elongate body, each latch member of the at least one latch member being positioned in engagement with a corresponding driving surface of the second wedge portion of the driving member, wherein, upon movement of the driving member in a first direction substantially parallel to the longitudinal axis of the driving member, the at least one driving surface of the second wedge portion is configured to wedge the at least one latch member between the inner surface of the head assembly and the at least one driving surface such that the overshot securely engages the inner surface of the head assembly.

In another exemplary aspect, upon movement of the driving member in a second direction opposed to the first direction and substantially parallel to the longitudinal axis of the driving member, the at least one latch member can be retracted relative to the inner surface of the head assembly.

In one exemplary aspect, an overshot is provided for use in a drilling system. The drilling system can have a wireline and a head assembly. The head assembly can have a proximal end defining an opening and an inner surface defining a central bore of the head assembly. The overshot can comprise a proximal portion configured for coupling to the wireline. The overshot can further comprise a distal portion coupled to the head assembly. The overshot can further comprise a pivot joint element positioned between and coupled to the proximal portion and the distal portion of the overshot. The distal portion can be configured for pivotal movement in at least two planes relative to the proximal portion.

In another exemplary aspect, the proximal portion of the overshot can have an inner surface defining a chamber, wherein the distal portion of the overshot has an inner surface defining a central bore, and wherein the pivot joint element comprises: a first end portion configured for receipt within the chamber of the proximal portion of the overshot; and a second end portion configured for secure attachment to the distal portion of the overshot upon receipt of the second end portion within the central bore of the distal portion of the overshot.

In another exemplary aspect, the proximal and distal portions of the overshot can have respective longitudinal axes, wherein the proximal portion of the overshot comprises an engagement surface positioned in communication with the chamber of the proximal portion and oriented substantially perpendicularly to the longitudinal axis of the proximal portion, wherein the first end portion of the pivot joint element comprises a ball joint having a substantially flat end surface, and wherein, upon positioning of the pivot joint element such that the end surface of the first end portion is substantially flush with the engagement surface of the proximal portion of the overshot, the longitudinal axes of the proximal and distal portions of the overshot are substantially axially aligned.

In another exemplary aspect, the pivot joint element can be configured for pivotal movement in a first plane relative to the proximal portion of the overshot such that the longitudinal axis of the distal portion of the overshot is substantially perpendicular to the longitudinal axis of the proximal portion of the overshot.

In another exemplary aspect, the inner surface of the proximal portion of the overshot can define a slot configured to receive the pivot joint element when the longitudinal axis of the distal portion of the overshot is positioned substantially perpendicularly relative to the longitudinal axis of the proximal portion of the overshot.

In another exemplary aspect, the pivot joint element can be configured for pivotal movement in three perpendicular planes relative to the proximal portion of the overshot such that the longitudinal axis of the distal portion of the overshot is positioned at an orientation angle relative to the longitudinal axis of the proximal portion of the overshot, wherein the orientation angle ranges from about 0 degrees to about 45 degrees.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A drilling system for use in a drilling formation, comprising:

a head assembly having a longitudinal axis, an outer surface, an inner surface, and a proximal end, the inner surface of the head assembly defining a central bore, the proximal end of the head assembly defining an opening in operative communication with the central bore; and an overshot having:

a proximal portion configured for coupling to a wireline, wherein the proximal portion has a longitudinal axis and an inner surface defining a chamber, wherein the proximal portion of the overshot comprises an engagement surface positioned in communication with the chamber and oriented substantially perpendicularly to the longitudinal axis of the proximal portion of the overshot, a distal portion configured for receipt within the central bore of the head assembly, wherein the distal portion of the overshot has a longitudinal axis and an inner surface defining a central bore, and wherein the distal portion comprises at least one latch member configured for movement about and between a latched position and a retracted position; and a pivot joint element positioned between and coupled to the proximal portion and the distal portion of the overshot, wherein the distal portion is configured for pivotal movement in at least two planes relative to the proximal portion, wherein the pivot joint element comprises:

a first end portion configured for receipt within the chamber of the proximal portion of the overshot, wherein the first end portion of the pivot joint element comprises a ball joint having a substantially flat end surface; and a second end portion configured for secure attachment to the distal portion of the overshot upon receipt of the second end portion within the central bore of the distal portion of the overshot, wherein, upon positioning of the pivot joint element such that the end surface of the first end portion is substantially flush with the engagement surface of the proximal portion of the overshot, the longitudinal axes of the proximal and distal portions of the overshot are substantially axially aligned, wherein the inner surface of the head assembly is configured for secure engagement with the at least one latch member of the overshot when the at least one latch member is positioned in the latched position, and wherein, upon secure engagement between the at least one latch member of the overshot and the inner surface of the head assembly, the head assembly is operatively coupled to the overshot such that movement of the overshot results in a corresponding movement of the head assembly.

2. The drilling system of claim 1, wherein the inner surface of the head assembly defines an inner diameter of the head assembly, and wherein, when the at least one latch member of the overshot is positioned in the retracted position, the at least one latch member defines an outer diameter of the distal portion of the overshot that is less than the inner diameter of the assembly.

3. The drilling system of claim 2, wherein the head assembly comprises a retracting element having an inner surface that is configured for engagement with the at least one latch member of the overshot to move the at least one latch member from the latched position to the retracted position.

4. The drilling system of claim 2, wherein the at least one latch member is biased toward the latched position.

5. An overshot for use in a drilling system, the drilling system having a wireline and a head assembly, the head assembly having a proximal end defining an opening and an inner surface defining a central bore of the head assembly, the overshot comprising:

a proximal portion configured for coupling to the wireline, wherein the proximal portion of the overshot has a longitudinal axis and an inner surface defining a chamber, wherein the proximal portion comprises an engagement surface positioned in communication with the chamber of the proximal portion and oriented substantially perpendicularly to the longitudinal axis of the proximal portion;

a distal portion coupled to the head assembly, wherein the distal portion of the overshot has a longitudinal axis and an inner surface defining a central bore; and a pivot joint element positioned between and coupled to the proximal portion and the distal portion of the overshot, wherein the pivot joint element comprises:

a first end portion configured for receipt within the chamber of the proximal portion of the overshot, wherein the first end portion comprises a ball joint having a substantially flat end surface; and a second end portion configured for secure attachment to the distal portion of the overshot upon receipt of the second end portion within the central bore of the distal portion of the overshot, wherein, upon positioning of the pivot joint element such that the end surface of the first end portion is substantially flush with the engagement surface of the proximal portion of the overshot, the longitudinal axes of the proximal and distal portions of the overshot are substantially axially aligned, wherein the distal portion of the overshot is configured for pivotal movement in at least two planes relative to the proximal portion of the overshot.

6. The overshot of claim 5, wherein the distal portion of the overshot comprises:

an elongate body having a wall and an outer surface, the wall of the elongate body defining a central bore of the elongate body and at least one distal radial opening extending from the outer surface to the central bore of the elongate body;

at least one latch member configured for movement about and between a latched position and a retracted position; and a driving member positioned at least partially within the central bore of the elongate body, the driving member having a longitudinal axis and a first wedge portion, the first wedge portion defining at least one driving surface, each driving surface of the at least one driving surface of the first wedge portion being tapered relative to the longitudinal axis of the driving member, wherein the at least one latch member is configured for receipt within the at least one distal radial opening of the elongate body, each latch member of the at least one latch member being positioned in engagement with a corresponding driving surface of the first wedge portion of the driving member, wherein, upon movement of the driving member in a first direction substantially parallel to the longitudinal axis of the driving member, the at least one driving surface of the driving member is configured to wedge the at least one latch member between the inner surface of the head assembly and the at least one driving surface such that the overshot securely engages the inner surface of the head assembly.

7. The overshot assembly of claim 6, wherein, upon movement of the driving member in a second direction opposed to the first direction and substantially parallel to the longitudinal axis of the driving member, the at least one latch member is retracted relative to the inner surface of the head assembly.

8. The overshot of claim 5, wherein the pivot joint element is configured for pivotal movement in a first plane relative to the proximal portion of the overshot such that the longitudinal axis of the distal portion of the overshot is substantially perpendicular to the longitudinal axis of the proximal portion of the overshot.

9. The overshot of claim 8, wherein the inner surface of the proximal portion of the overshot defines a slot configured to receive the pivot joint element when the longitudinal axis of the distal portion of the overshot is positioned substantially perpendicularly relative to the longitudinal axis of the proximal portion of the overshot.

10. The overshot of claim 5, wherein the pivot joint element is configured for pivotal movement in three perpendicular planes relative to the proximal portion of the overshot such that the longitudinal axis of the distal portion of the overshot is positioned at an orientation angle relative to the longitudinal axis of the proximal portion of the overshot, wherein the orientation angle ranges from about 0 degrees to about 45 degrees.

11. A drilling system for use in a drilling formation, comprising:

a head assembly having a longitudinal axis, an outer surface, an inner surface, and a proximal end, the inner surface of the head assembly defining a central bore, the proximal end of the head assembly defining an opening in operative communication with the central bore; and an overshot having:

a proximal portion configured for coupling to a wireline, wherein the proximal portion has a longitudinal axis and an inner surface defining a chamber, wherein the proximal portion of the overshot comprises an engagement surface positioned in communication with the chamber, a distal portion configured for receipt within the central bore of the head assembly, wherein the distal portion of the overshot has a longitudinal axis and an inner surface defining a central bore, and wherein the distal portion comprises at least one latch member configured for movement about and between a latched position and a retracted position; and a pivot joint element positioned between and coupled to the proximal portion and the distal portion of the overshot, wherein the distal portion is configured for pivotal movement in at least two planes relative to the proximal portion, wherein the pivot joint element comprises:

a first end portion configured for receipt within the chamber of the proximal portion of the overshot, wherein the first end portion of the pivot joint element comprises a ball joint configured for engagement with the engagement surface of the proximal portion; and a second end portion configured for secure attachment to the distal portion of the overshot upon receipt of the second end portion within the central bore of the distal portion of the overshot, wherein the pivot joint element is configured for pivotal movement in a first plane relative to the proximal portion of the overshot such that the longitudinal axis of the distal portion of the overshot is substantially perpendicular to the longitudinal axis of the proximal portion of the overshot, wherein the inner surface of the head assembly is configured for secure engagement with the at least one latch member of the overshot when the at least one latch member is positioned in the latched position, and wherein, upon secure engagement between the at least one latch member of the overshot and the inner surface of the head assembly, the head assembly is operatively coupled to the overshot such that movement of the overshot results in a corresponding movement of the head assembly.

12. The drilling system of claim 11, wherein the inner surface of the head assembly defines an inner diameter of the head assembly, and wherein, when the at least one latch member of the overshot is positioned in the retracted position, the at least one latch member defines an outer diameter of the distal portion of the overshot that is less than the inner diameter of the assembly.

13. The drilling system of claim 12, wherein the at least one latch member is biased toward the latched position.

14. An overshot for use in a drilling system, the drilling system having a wireline and a head assembly, the head assembly having a proximal end defining an opening and an inner surface defining a central bore of the head assembly, the overshot comprising:

a proximal portion configured for coupling to the wireline, wherein the proximal portion of the overshot has a longitudinal axis and an inner surface defining a chamber, wherein the proximal portion comprises an engagement surface positioned in communication with the chamber of the proximal portion;

a distal portion coupled to the head assembly, wherein the distal portion of the overshot has a longitudinal axis and an inner surface defining a central bore, wherein the distal portion of the overshot comprises:

an elongate body having a wall and an outer surface, the wall of the elongate body defining a central bore of the elongate body and at least one distal radial opening extending from the outer surface to the central bore of the elongate body;

a driving member positioned at least partially within the central bore of the elongate body, the driving member having a longitudinal axis and a first wedge portion, the first wedge portion defining at least one driving surface, each driving surface of the at least one driving surface of the first wedge portion being tapered relative to the longitudinal axis of the driving member; and at least one latch member configured for receipt within the at least one distal radial opening of the elongate body, each latch member of the at least one latch member being positioned in engagement with a corresponding driving surface of the first wedge portion of the driving member, wherein, upon movement of the driving member in a first direction substantially parallel to the longitudinal axis of the driving member, the at least one driving surface of the driving member is configured to wedge the at least one latch member between the inner surface of the head assembly and the at least one driving surface such that the overshot securely engages the inner surface of the head assembly; and a pivot joint element positioned between and coupled to the proximal portion and the distal portion of the overshot, wherein the pivot joint element comprises:

a first end portion configured for receipt within the chamber of the proximal portion of the overshot, wherein the first end portion comprises a ball joint configured for engagement with the engagement surface of the proximal portion; and a second end portion configured for secure attachment to the distal portion of the overshot upon receipt of the second end portion within the central bore of the distal portion of the overshot, wherein the distal portion of the overshot is configured for pivotal movement in at least two planes relative to the proximal portion of the overshot, and wherein the pivot joint element is configured for pivotal movement in a first plane relative to the proximal portion of the overshot such that the longitudinal axis of the distal portion of the overshot is substantially perpendicular to the longitudinal axis of the proximal portion of the overshot.

15. The overshot of claim 14, wherein the engagement surface of the proximal portion is oriented substantially perpendicularly to the longitudinal axis of the proximal portion, wherein the ball joint of the first end portion of the pivot joint element has a substantially flat end surface, and wherein upon positioning of the pivot joint element such that the end surface of the first end portion is substantially flush with the engagement surface of the proximal portion of the overshot, the longitudinal axes of the proximal and distal portions of the overshot are substantially axially aligned.

16. The overshot of claim 14, wherein the inner surface of the proximal portion of the overshot defines a slot configured to receive the pivot joint element when the longitudinal axis of the distal portion of the overshot is positioned substantially perpendicularly relative to the longitudinal axis of the proximal portion of the overshot.

17. The overshot assembly of claim 14, wherein, upon movement of the driving member in a second direction opposed to the first direction and substantially parallel to the longitudinal axis of the driving member, the at least one latch member is retracted relative to the inner surface of the head assembly.

* * * * *